US009399895B2

(12) United States Patent
Goddard

(10) Patent No.: US 9,399,895 B2
(45) Date of Patent: Jul. 26, 2016

(54) COILED TUBING INJECTOR HEAD WITH CHAIN GUIDES

(75) Inventor: Timothy James Goddard, Fakenham (GB)

(73) Assignee: National Oilwell Varco L.P., Houston, TX (US)

( * ) Notice: Subject to any disclaimer, the term of this patent is extended or adjusted under 35 U.S.C. 154(b) by 479 days.

(21) Appl. No.: 13/601,197

(22) Filed: Aug. 31, 2012

(65) Prior Publication Data

US 2013/0233571 A1 Sep. 12, 2013

Related U.S. Application Data

(60) Provisional application No. 61/530,540, filed on Sep. 2, 2011.

(51) Int. Cl.
*E21B 19/22* (2006.01)

(52) U.S. Cl.
CPC ..... *E21B 19/22* (2013.01)

(58) Field of Classification Search
CPC ..... E21B 19/22; B66D 3/003
USPC ..... 166/384, 77.3
See application file for complete search history.

(56) References Cited

U.S. PATENT DOCUMENTS

| | | | | |
|---|---|---|---|---|
| 2,282,597 | A | 5/1942 | Archer | |
| 2,567,009 | A | 9/1951 | Calhoun et al. | |
| 2,896,777 | A | 7/1959 | Hallam | |
| 3,056,535 | A | 10/1962 | Baugh et al. | |
| 3,182,877 | A | 5/1965 | Slator et al. | |
| 3,216,639 | A | 11/1965 | Andre | |
| 3,285,485 | A | 11/1966 | Slator | |
| 3,373,818 | A | 3/1968 | Rike et al. | |
| 3,401,749 | A | 9/1968 | Daniel | |
| 3,559,905 | A | 2/1971 | Palynchuk | |
| 3,618,840 | A | 11/1971 | Courret | |
| 3,638,288 | A | 2/1972 | Pryor | |
| 3,667,554 | A | 6/1972 | Smitherman | |
| 3,680,342 | A * | 8/1972 | Mott et al. | 72/161 |

(Continued)

FOREIGN PATENT DOCUMENTS

| | | | |
|---|---|---|---|
| CA | 953644 | A | 8/1974 |
| CA | 1056808 | A | 6/1979 |

(Continued)

OTHER PUBLICATIONS

International Search Report and Written Opinion received in Patent Cooperation Treaty Application No. PCT/US2011/049684, Nov. 29, 2011, 13 pages.

(Continued)

*Primary Examiner* — Robert E Fuller
(74) *Attorney, Agent, or Firm* — Hubbard Law, PLLC

(57) ABSTRACT

In an injector head (30) for handling tubing for insertion into and retrieval from a wellbore, a non-gripping portion of the path (22) of each chain loop (12), which is otherwise susceptible to oscillations when running in at least certain conditions, is constrained by a chain guide (44). The chain guide allows the chain to move freely as it is driven by the sprockets (16) in a loop, but dampens or prevents development of oscillations in the chain loop (12) when moving along one or more sections of its path in which it is not otherwise be pressed against tubing or constrained by sprockets or tensioners.

11 Claims, 3 Drawing Sheets

(56) References Cited

U.S. PATENT DOCUMENTS

| | | | | | |
|---|---|---|---|---|---|
| 3,690,136 | A | | 9/1972 | Slator et al. | |
| 3,724,567 | A | | 4/1973 | Smitherman | |
| 3,778,094 | A | | 12/1973 | Grolet et al. | |
| 3,822,559 | A | | 7/1974 | Matthews et al. | |
| 3,824,875 | A | | 7/1974 | Willert et al. | |
| 3,827,487 | A | | 8/1974 | Jackson et al. | |
| 3,866,882 | A | | 2/1975 | Willm et al. | |
| 3,920,076 | A | | 11/1975 | Laky | |
| 4,013,205 | A | | 3/1977 | Fabre-Curtat et al. | |
| 4,172,391 | A | | 10/1979 | Dressel | |
| 4,469,267 | A | * | 9/1984 | Franchuk et al. | 226/172 |
| 4,515,220 | A | * | 5/1985 | Sizer et al. | 166/384 |
| 4,585,061 | A | | 4/1986 | Lyons, Jr. et al. | |
| 4,655,291 | A | | 4/1987 | Cox | |
| 4,792,075 | A | * | 12/1988 | Umlauf | 226/172 |
| 4,899,620 | A | | 2/1990 | Schiffer | |
| 5,133,405 | A | | 7/1992 | Elliston | |
| 5,188,174 | A | | 2/1993 | Anderson, Jr. | |
| 5,234,053 | A | | 8/1993 | Connell | |
| 5,309,990 | A | | 5/1994 | Lance | |
| 5,381,861 | A | | 1/1995 | Crafton et al. | |
| 5,533,659 | A | | 7/1996 | Meyer | |
| 5,553,668 | A | | 9/1996 | Council et al. | |
| 5,566,764 | A | | 10/1996 | Elliston | |
| 5,775,417 | A | | 7/1998 | Council | |
| 5,850,874 | A | | 12/1998 | Burge et al. | |
| 5,853,118 | A | | 12/1998 | Avakov | |
| 5,890,534 | A | | 4/1999 | Burge et al. | |
| 5,918,671 | A | | 7/1999 | Bridges et al. | |
| 5,937,943 | A | | 8/1999 | Butler | |
| 5,975,203 | A | | 11/1999 | Payne et al. | |
| 6,059,029 | A | | 5/2000 | Goode | |
| 6,135,202 | A | | 10/2000 | Koshak | |
| 6,173,769 | B1 | | 1/2001 | Goode | |
| 6,216,780 | B1 | | 4/2001 | Goode et al. | |
| 6,332,501 | B1 | | 12/2001 | Gipson | |
| 6,347,664 | B1 | | 2/2002 | Perio, Jr. | |
| 6,516,891 | B1 | | 2/2003 | Dallas | |
| 6,663,523 | B1 | * | 12/2003 | Chiuch | 474/226 |
| 6,880,629 | B2 | | 4/2005 | Schroeder | |
| 6,910,530 | B2 | | 6/2005 | Austbo et al. | |
| 7,150,330 | B2 | | 12/2006 | Domann | |
| 7,383,879 | B2 | | 6/2008 | Kulhanek et al. | |
| 7,431,097 | B2 | | 10/2008 | Weightmann | |
| 2003/0034162 | A1 | | 2/2003 | Kulhanek | |
| 2005/0205267 | A1 | | 9/2005 | Dallas | |
| 2006/0076148 | A1 | | 4/2006 | Kulhanek et al. | |
| 2007/0246261 | A1 | | 10/2007 | Lowe et al. | |
| 2009/0091278 | A1 | | 4/2009 | Montois et al. | |
| 2009/0250205 | A1 | | 10/2009 | Koopmans et al. | |

FOREIGN PATENT DOCUMENTS

| | | | |
|---|---|---|---|
| CA | 1096850 | A | 3/1981 |
| EP | 0507280 | A | 10/1992 |
| EP | 0524648 | A | 1/1993 |
| GB | 2029478 | A | 3/1980 |
| GB | 2247260 | A | 2/1992 |
| JP | 37228358 | A | 8/1995 |
| WO | 0008296 | A | 2/2000 |
| WO | 01/14075 | A1 | 3/2001 |
| WO | 2005003505 | A | 1/2005 |

OTHER PUBLICATIONS

International Search Report and Written Opinion received in Patent Cooperation Treaty Application No. PCT/US2012/053397, Mar. 19, 2013, 12 pages.

Chrysler Sebring: Timing Marks . . . Main Timing Chain at 12:00 . . . Sprocket, Just Answer, Chrysler, http://www.justanswer.com/chrysler/6pm1c-chrysler-sebring-2-7-chrysler-sebring-2-7.html, last accessed Mar. 7, 2016.

Ford Explorer Sport 2001 Model Engine 4.0 V6, There Some Noise, Just Answer. Ford, http://www.justanswer.com/ford/3kmhe-ford-explorer-sport-2001-model-engine-4-0-v6-there-noise.html, last accessed Mar. 7, 2016.

Chinese Office Action and English translation received in Chinese Application No. 201280052196.8, dated May 18, 2015, 15 pages.

* cited by examiner

COILED TUBING INJECTOR HEAD WITH CHAIN GUIDES

CROSS REFERENCE TO RELATED APPLICATION

This application claims the benefit of U.S. provisional application No. 61/530,540, filed Sep. 2, 2011, entitled "Coiled Tubing Injector Head with Chain Guides," which is incorporated herein in its entirety by reference for all purposes.

BACKGROUND

The invention relates generally to tubing injectors for insertion of tubing into and retrieval from a well bore.

Coiled tubing well intervention has been known in the oil production industry for many years. A great length, often exceeding 15,000 feet, of small diameter, typically 1.5 inch, steel tubing is handled by coiling on a large reel, which explains the name of coiled tubing. The tubing reel cannot be used as a winch drum, since the stresses involved in using it, as a winch would destroy the tubing. The accepted solution in the oil industry is to pull tubing from the reel as it is required and pass it around a curved guide arch, or 'gooseneck,' so that it lies on a common vertical axis with the well bore. To control passage of tubing into and out of the well bore, a device called a coiled tubing injector head is temporarily mounted on the wellhead, beneath the guide arch. By use of the injector head, the tubing weight and payload is taken from the approximately straight tubing at the wellhead, leaving only a small tension necessary for tidy coiling to the tubing reel. Examples of coiled tubing injectors include those shown and described in U.S. Pat. Nos. 5,309,990, 6,059,029, and 6,173,769, all of which are incorporated herein by reference. Coiled tubing injector heads can also be used to run straight, jointed pipe in and out of well bores. General references to "tubing" herein should be interpreted to include both coiled tubing and jointed pipe, unless the context clearly indicates otherwise.

Coiled tubing is externally flush and is thus well adapted for insertion through a pressure retaining seal, or stuffing box, into a live well, meaning one with wellhead pressure that would eject fluids if not sealed. In a conventional coiled tubing application, an injector head needs to be able to lift, or pull, 40,000 pounds or more as tubing weight and payload when deep in the well. It also has to be able to push, or snub, 20,000 pounds or more to overcome stuffing box friction and wellhead pressure at the beginning and end of a trip into a well bore. Coiling tension is controlled by a tubing reel drive system and remains approximately constant no matter if the injector head is running tubing into or out of the well, or if it is pulling or snubbing. The coiling tension is insignificant by comparison to tubing weight and payload carried by the tubing in the well bore and is no danger to the integrity of the tubing. The tubing is typically run to a great depth in the well and then cycled repetitively over a shorter distance to place chemical treatments or to operate tools to rectify or enhance the well bore. It is by careful control of the injector head that the coiled tubing operator manipulates the tubing depth and speed to perform the programmed tasks.

In order that the injector head may manipulate tubing, it has to grip the tubing and then, concurrently, move the means of gripping so as to move the tubing within the well bore. Although other methods of achieving this aim are known, injector heads used for well intervention and drilling utilize a plurality of chain loops for gripping the tubing. There are many examples of such injector heads. Most rely on roller chains and matching sprocket forms as the means of transmitting drive from the driving shafts to the chain loop assemblies. Roller chain is inexpensive, very strong, and flexible. Yet, when the roller chain is assembled with grippers, which sometimes are comprised of a removable gripping element or block mounted to a carrier, the result is a massive subassembly, which is required to move at surface speeds of up to 300 feet per minute in some applications, changing direction rapidly around the drive and tensioner sprockets.

FIG. 1 schematically illustrates the basic components of an injector head that is a representative example of injector heads used for running tubing in and out of oil and gas wells. The injector head comprises, in this example, two closed or endless chains loops 12, though more than two can be employed. Each chain loop 12, which is closed or endless, is moved by drive shafts 14 via mounted sprockets 16 engaging with roller chain links, which form part of the total chain loop assembly. Each chain loop 12 has disposed on it a plurality of gripping blocks. As each chain loop is moved through a predetermined path, the portion of each chain loop that is adjacent to the other chain loop(s) over an essentially straight and parallel length, which is also the portion of its path along tubing 18, is forced by some means, for example the hydraulically motivated roller and link assembly 20, toward the tubing 18, so that the grippers along this portion of the path of the chain loop, which may be referred to as the gripping portion, length or zone, engage and are forced against the tubing 18, thereby generating a frictional force between the grippers and the coiled tubing that results in a firm grip. The non-gripping length(s) 22 of each loop 12, which extends between the drive sprockets 16 and idler sprocket 24, contrast to the chain along the gripping portion of the path of the chain loop, is largely unsupported and is only controlled, in the illustrated example, by centrally mounted tensioner 26. However, many modern injectors dispense with the central tensioners on the non-gripping length and control the chain loop tension instead by means of adjustment at the bottom idler sprocket 24.

SUMMARY

Oscillations can develop in portions of the path along which a chain loop moves that is not being biased for gripping, particularly during deployment of small diameter coiled tubing, sometimes known as capillary tubing. These portions of the path of the chain loop, as well as the portions of the chain loop present at any given time in these portions of the path, will be referred to as the free, non-gripping or non-biased portions. In such deployments operational speeds are higher than those with larger tubing. Chain oscillations cause rough running of the injector head, with attendant noise, reduced tubing control and reduced service life. Increasing tension of the chain has been found to increase the frequency of oscillation without sufficient dampening of the oscillations, and thus does not solve this problem. Increased chain tension can also be deleterious to the injector head by increasing bearing loads, resulting in reduced efficiencies, increased wear rates and reduced service life.

In the representative examples of injector heads described below, which are comprised of a plurality of chain loops mounted on sprockets, at least one of the chains loops is supported along a free or unbiased portion of a path of the chain loop by a chain guide. The support of the chain guide dampens or substantially prevents chain oscillations that otherwise could or would develop when the injector head is operated under certain conditions, without the need of having to increase chain tension.

In one example of an injector head, a straight portion of the path of each of a plurality of chain loops that extends between the sprockets, adjacent to the other chain loop(s), is biased for causing frictional engagement of grippers on the chains against tubing between the chain loops, so as to grip the tubing and allow its transit into and out of a well. An unbiased portion of the path of each chain loop on the other side of the sprockets from the biased portion of the chain, that is otherwise susceptible to oscillations when running in at least certain conditions, is constrained by a chain guide. The chain guide extends, in one embodiment, substantially over the full length of the unbiased section of the chain loop between the sprockets. The chain guide allows the chain to move freely as it is driven by the sprockets in loop, but dampens or prevents development of oscillations in the chain loop along one or more portions of its path in which it is not otherwise being pressed against tubing or constrained by sprockets or tensioners.

DETAILED DESCRIPTION OF EXEMPLARY EMBODIMENTS

In the following description, like numbers refer to the same or similar features or elements throughout. The drawings are not to scale and some aspects of various embodiments may be shown exaggerated or in a schematic form.

Figure 1:
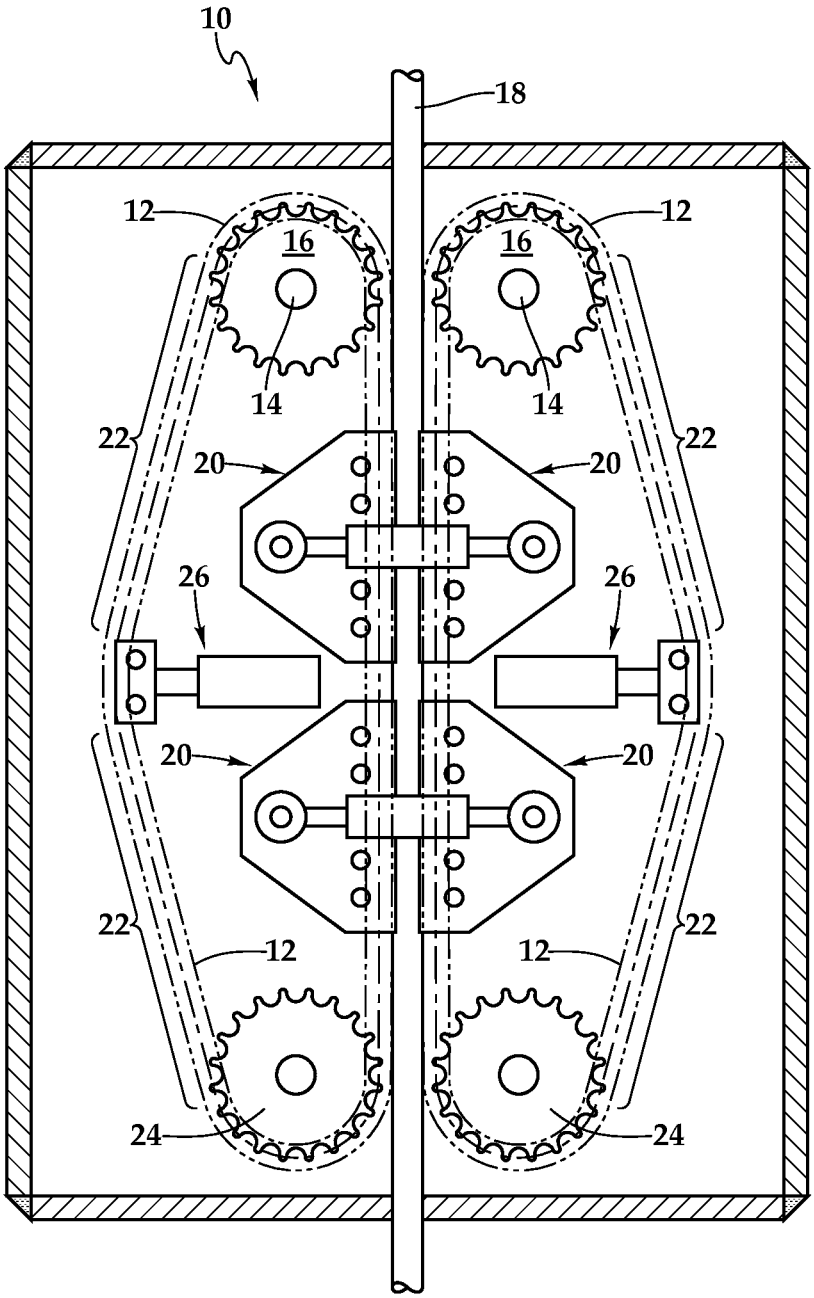
Fig.1 (PRIOR ART)
FIG. 1 illustrates basic components of a typical coiled tubing injector head of a general type, as found in the prior art.
Figure 4:
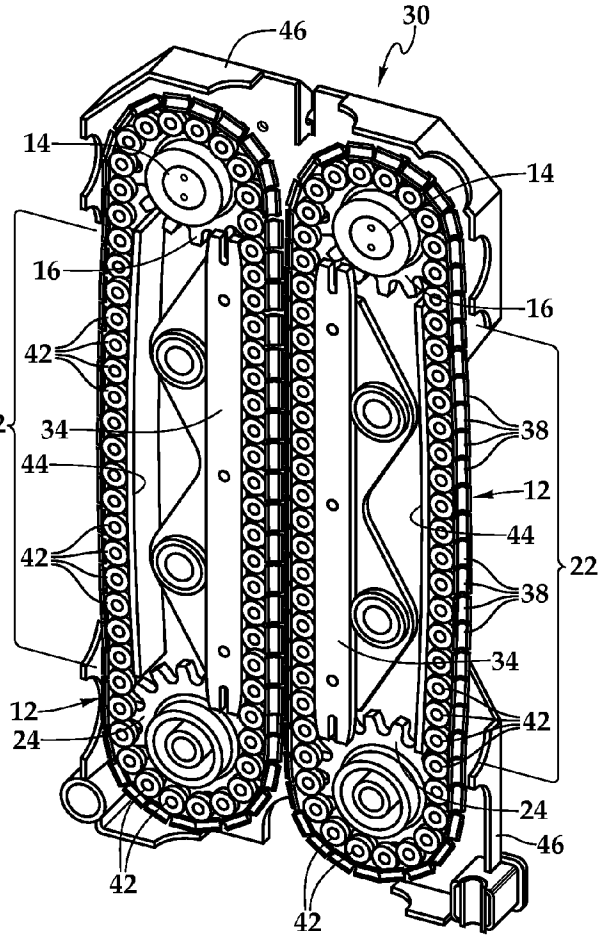
FIG. 4 is an isometric, sectional view of the representative coiled tubing injector of FIG. 3.
Figure 3:
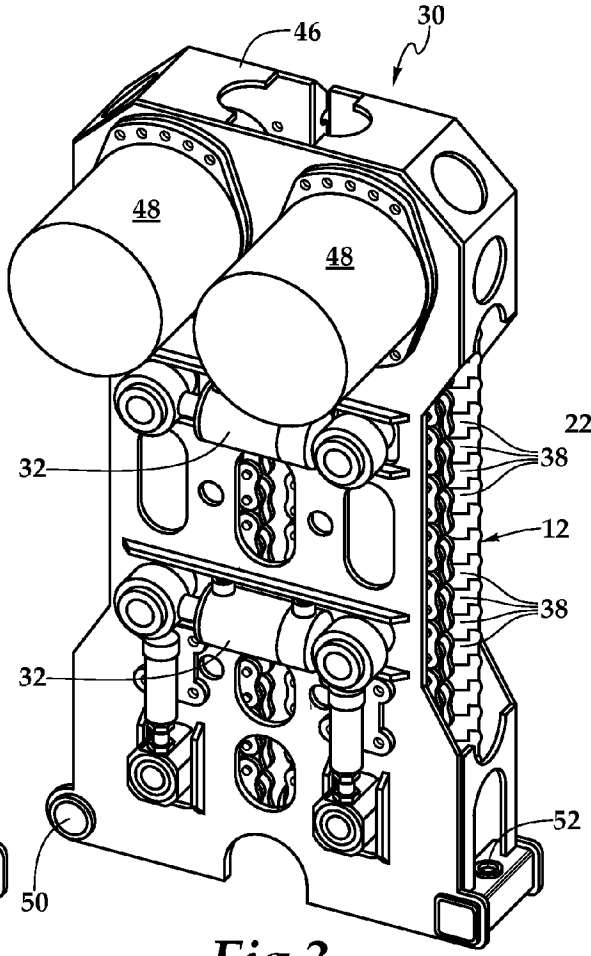
FIG. 3 illustrates an isometric view of a representative coiled tubing injector comprising the frame of FIG. 2.
Figure 2:
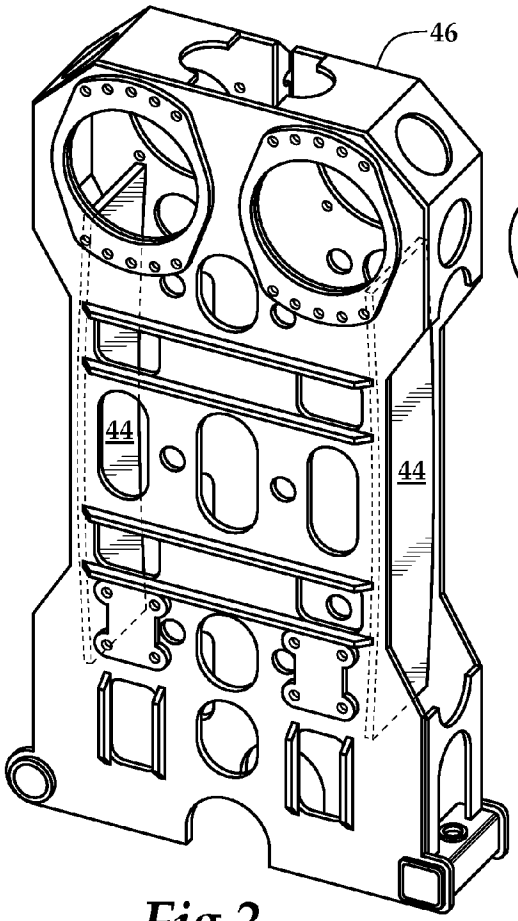
FIG. 2 illustrates an embodiment of a frame for a coiled tubing injector, in an isometric view, with a continuously curved chain guide surface incorporated into a machine frame.

With reference to FIGS. 2, 3, 4, and 5 coiled tubing injector head 30 has many of the same basic elements as injector head 10 of FIG. 1, and therefore the same reference numbers are used for similar elements. However, use of the same numbers does not imply identity. The injector head 30 comprises a plurality of endless or closed chain loops 12 mounted to move along an elongated closed loop or path. A section of each chain loop path adjacent to the other chain loop paths is, in this example, practically straight, enabling engagement of an extended length of tubing when between the chain loops. The chain along this portion of the path is so that the gripping elements, disposed on the chains are biased toward each other, so that they are pressed against tubing inserted between the chain loops by a normal force. This portion of the path, and the length of chain along this portion of the path, may be referred to as the gripping or biased portion, length, zone, or segment. The mechanism or system used for biasing could include, for example, a biasing means similar to biasing means 20 of the exemplary injector head 10 of FIG. 1. The biasing system illustrated by FIGS. 3 and 4 includes hydraulic rams 32 acting on pressure bars 32, also referred to as skates. No particular form or construction or pressure bar or skate is intended to be implied. It could be a single element or comprised of multiple elements. In this particular example, the rams pull together opposing pressure bars. Any other mechanism or structure for causing gripping elements on a chain to be urged or pressed against the tubing would be substantially equivalent to this example and other examples given above for purposes of the invention described herein.

Figure 5:
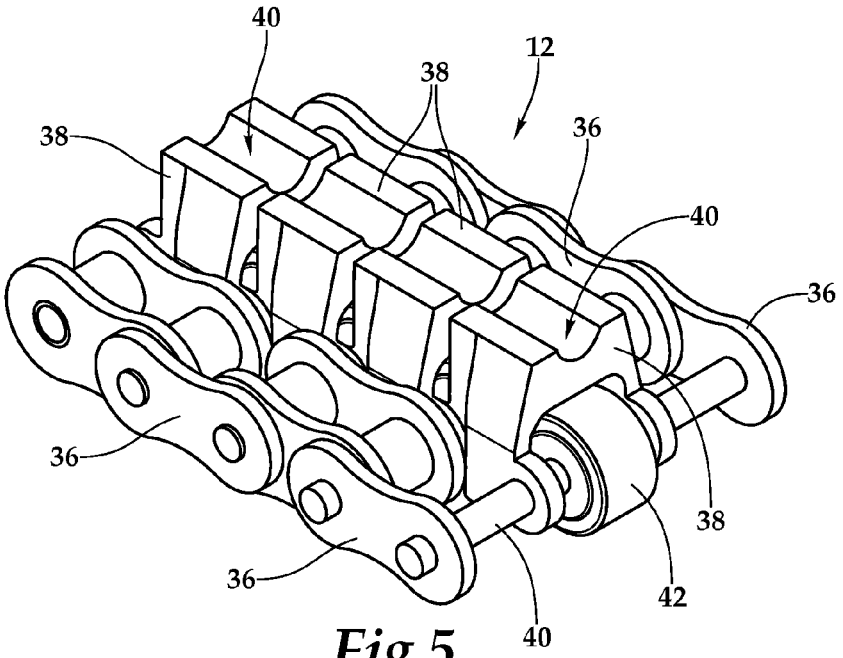
FIG. 5 shows a section of a representative chain loop assembly for use in connection with a coiled tubing injector of FIGS. 2, 3 and 4, illustrating roller chains, with gripping elements to the front and rolling elements to the back.

Referring now only to FIG. 5, the chain loops 12 are, in this example, of the type comprising roller chain, which is comprised of roller links 36, with gripping elements 38 mounted on pins 40. One or more of the gripping elements can be of a type, for example, that comprise a carrier portion connected to one of the pins 40 in the chain, and a gripper attached or joined to the carrier in a removable fashion. The gripper 38 has a portion 40 that is shaped for engaging the tubing. On the back of each gripping element is mounted a rolling element in the form of a roller 42. The rolling elements are positioned to facilitate free motion of the chain assembly along the pressure bar 34. Rollers 42 on the backside of the gripping elements 38 connected to the chains roll along the pressure bars, causing the gripping elements 38 to be pressed against tubing captured between the chains, and thus create a normal force that increases the friction between the gripping elements and the tubing, allowing the chain loops to grip the tubing between them and transit the tubing into and out of a well by motion of the chains. Alternately, rollers could be carried by the biasing means.

Referring now back to FIGS. 2-5, in the illustrated embodiment, the roller 42 is also positioned to roll along a chain guide. The chain guide is in the form of elongated member 44 that constrains non-gripping or non-biased portions 22 of the path of each of the chain loops 12. The illustrated embodiment of the chain guide is continuously curved and positioned such that it contacts the portion of the chain loop over a length of its path in which it will not be pressed against or gripping tubing or otherwise constrained by sprockets or tensioners, ending close to both the drive sprocket 16 at the top and the idler/tensioner sprocket 24 at the bottom. The elongated curved member can be made from, for example, one or more steel plates. The roller 42 on the back of each gripper rolls along the curved member 44. Furthermore, this particular guide is an example of a structural element that has been incorporated into the machine frame 46. The elongated curved member forming the illustrated guide has been welded to the frame. The machine frame transmits from the load-bearing drive shafts 14 at the top of the frame, which are drive by hydraulic motors 48, to pivot and load cell points, 48 and 50, respectively, at the bottom. By combining load carrying with chain guide, the frame 46 reduces or minimizes the space and mass requirements of both functions.

Figure 6A:
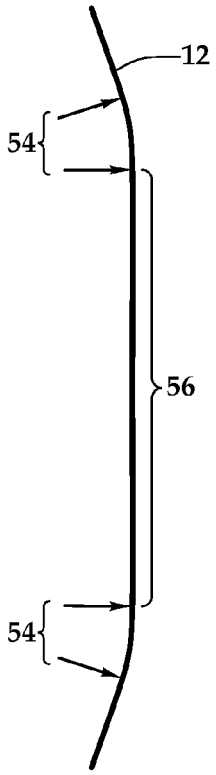
FIGS. 6A and 6B are schematic diagrams illustrating that a continuously curved guide surface for a free portion of a chain provides a distributed radial force.
Figure 6B:
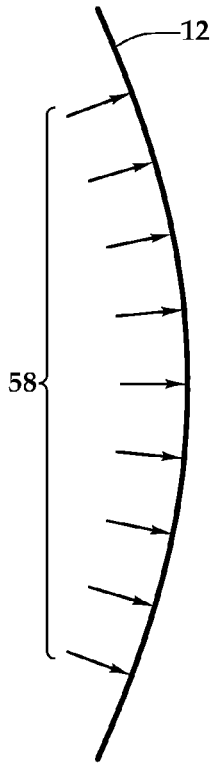

Referring to FIGS. 6A and 6B, each chain loop 12 of an injector head, such as the ones shown in FIGS. 1-5, comprises a flexible tensile member with distributed mass. It maintains a constant tensile force at any point throughout its entire length. If the member is of constant section and material, it will have its mass evenly distributed along its length. The chain will have a resistance to bending, but this may be very low. The combination of such a member's mass, flexibility, length, and tension together provide the mechanism for oscillation. Higher mass and greater length reduce the frequency of oscillation; higher tension increases it. Once induced, an oscillation in such a system will persist until its energy is exhausted by friction.

Any deflection of a continuous, flexible, tensile member from a straight path causes a compressive load approximately perpendicular to the tensile force. Conversely, if there is no deflection there will be no force. FIG. 6A shows a representation of chain 12 constrained by slight deflections 54 at the top and at the bottom. A length of chain 56 between the constraints causing the deflections is significant and may sustain an oscillation. FIG. 6B illustrates an embodiment showing frequent small deflections 58, caused by a plurality of constraints placed along the path of the chain, distributed from top to bottom, approximating a continuously curved path for the flexible tensile member. When a sufficient number of constraints are provided along the length, the system will no longer have a frequency that can be excited by the environment. Provision of frequent small deflections along its length sufficiently constrains or controls the chains so that oscillations caused by the environment of the chain are effectively blocked without necessarily having to increase substantially the tension on the chain.

Chain guide 13 in FIGS. 2-5 provides a continuous, curved path for the chain loop and has the advantage of being incorporated into a frame. Furthermore, such a guide is well adapted for a roller chain with rolling elements mounted to its backside. However, multiple structures that provide a sufficient number of constrains along the length of the free portion of the chain could be substituted for it. One example includes two or more curved segments, which can be separated by gaps that together approximate a continuously curved path. Another example comprises multiple, discretely positioned constraints in the form of, for example, a bearing surface or, for chains without rolling elements, a roller which are appropriately spaced apart or distributed to prevent the environment from inducing oscillations in the unsupported portions of the chain that extend between the constraints.

The invention, as defined by the appended claims, is not limited to the described embodiments, which are intended only as examples. Alterations and modifications to the disclosed embodiments may be made without departing from the invention. The meaning of the terms used in this specification are, unless expressly stated otherwise, intended to have ordinary and customary meaning and are not intended to be limited to the details of the illustrated or described structures or embodiments.

What is claimed is:

1. An injector head for transiting tubing in and out of well bores, comprising:

a frame;

a plurality of chain loops arranged adjacent to each other, each of the plurality of chain loops supported by the frame for movement along an elongated, closed path, at least one of which is driven, and each of which has disposed thereon a plurality of gripping elements and rollers; the plurality of chain loops being arranged for gripping tubing constrained between the chains and moving the tubing by movement of the chain loops along the elongated, closed path, the path having a gripping portion, along which gripper elements on different ones of the plurality of chains are being forced toward each other by a biasing system comprising pressures bars acted on by rams; the gripping portion of the closed path for each of the plurality of chains having one of the pressure bars disposed along the gripping portion; and a chain guide for constraining movement of one of the plurality of chains along a non-gripping portion of its path that is outside the gripping portion of the path; the chain guide constraining movement of the chain with at least a plurality of points along the free segment of the non-gripping portion of the path, the points being spaced apart for effectively preventing oscillation of the free segment of the chain;

wherein the chain guide is comprised of one or more continuously curved members extending along at least a portion of the non-gripping portion of the path of the one of the plurality of chains, along which the rollers of the at least one of the plurality of roller chains roll; and wherein the chain guide is a structural member that is fixedly incorporated into the frame in a fixed position relative to the frame.

2. The injector head of claim 1, wherein the rollers on the at least one of the plurality of chain loops rolls along the one or more continuously curved members when in the non-gripping portion of the path.

3. The injector head of claim 1, wherein each of the plurality of chains is mounted on a pair of spaced-apart sprockets, thereby forming between the sprockets, on one side of a line extending between respective axes of the sprockets, the gripping portion of its path, along which each of the plurality of chain loops is biased, and on the other side of the line between axes of the sprockets the non-gripping portion.

4. The injector head of claim 1, further comprising at least one sprocket for each each of the plurality of chain loops, the frame having two sides for supporting load bearing shafts on which the sprockets are mounted; wherein the one or more continuously curved members are connected between the two sides of the frame.

5. The injector head of claim 4, wherein the one or more continuously curved members are welded to the frame.

6. An injector head for transiting tubing in and out of well bores, comprising:

a frame;

a plurality of chain loops arranged adjacent each other, at least one of which is driven, and each of which has disposed thereon a plurality of gripping elements; each of the plurality of chain loops supported by the frame for movement along an elongated, closed path, the plurality of chain loops being arranged for gripping tubing constrained between the chains and moving the tubing by movement of the chain loops along the elongated, closed path;

means for biasing each of the plurality of chain loops, along a gripping portion of its path, toward the other chains, thereby enabling generation of greater frictional force between the gripping elements on the chain loops and tubing constrained between the chains, the means for a biasing comprising pressures bars acted on by rams, the gripping portion of the closed path for each of the plurality of chains having disposed along it one of the pressure bars; and means for constraining movement of at least one of the plurality of chains along at least one segment, a non-gripping portion of its path outside the biased, gripping portion of its path, the means for constraining effectively preventing oscillation of the portion of the at least one chain loop along the non-gripping portion of the path when transiting tubing in and out of well bores;

wherein the means for constraining is comprised of at least one elongated curved member fixedly incorporated into the frame as a structural element thereof in a fixed position relative to the frame.

7. The injector head of claim 6, wherein the means for constraining is comprised of at least a plurality of constraint points spaced along the non-gripping portion of the path, between which induced oscillations are prevented when the injector head is being operated.

8. The injector head of claim 6, wherein the at least one elongated member is welded to the frame.

9. The injector head of claim 6, further comprising at least one sprocket for each of the plurality of chain loops, and the frame comprises two sides for supporting load bearing shafts on which the sprockets are mounted; the at least one elongated curved member being connected between the two sides of the frame.

10. The injector head of claim 9, wherein the at least one elongated curved member is welded to the frame.

11. A method for operating an injector head for handling tubing for insertion into and out of a well bore, comprising, driving at least one of a plurality of chain loops arranged adjacent each other, each of which has disposed thereon a plurality of gripping elements and rollers on the backside of the gripping elements; the plurality of chain loops being arranged for gripping tubing constrained between the plurality of chain loops and moving the tubing by movement of the chain loops along an elongated, closed path;

gripping the tubing with the plurality of chain loops within a gripping portion of the closed path by pressing a pressure bar against the rollers of each of the plurality of chain loops, the rollers rolling along the pressure bar while in the gripping portion of the closed path; and constraining movement of at least one of the plurality of chains along at least one, unbiased, non-gripping portion of its path outside a gripping portion of its path that is being urged against the tubing, thereby dampening oscillation of the of the chain along the unbiased, non-gripping portion of the path when transiting tubing in and out of well bores while allowing movement of the chain along its path;

wherein constraining movement of at least one of the plurality of chains along the at least one, unbiased, non-gripping portion of its path comprises rolling the rollers of the chain along an at least one elongated curved member fixedly incorporated into the frame as a structural element thereof in a fixed position relative to the frame.

* * * * *